US005507707A

United States Patent [19]

Miller

[11] Patent Number: 5,507,707

[45] Date of Patent: Apr. 16, 1996

[54] ISOKINETIC CERVICAL EXERCISE DEVICE

[76] Inventor: Bruce W. Miller, P.O. Box 20267, Tampa, Fla.

[21] Appl. No.: 329,194

[22] Filed: Oct. 26, 1994

Related U.S. Application Data

[63] Continuation-in-part of Ser. No. 208,991, Mar. 10, 1994, abandoned, which is a continuation-in-part of Ser. No. 134,800, Oct. 12, 1993, Pat. No. 5,336,139, which is a continuation-in-part of Ser. No. 29,874, Mar. 11, 1993, abandoned.

[51] Int. Cl.[6] ..... A63B 23/025

[52] U.S. Cl. ..... 482/10; 482/43; 482/124; 482/120; 482/127

[58] Field of Search ..... 602/17, 18, 19; 482/10, 43, 124, 127, 120

[56] References Cited

U.S. PATENT DOCUMENTS

| | | | |
|---|---|---|---|
| 198,871 | 1/1878 | Case . | |
| 1,618,273 | 2/1927 | Davidson . | |
| 1,663,641 | 3/1928 | Smallwood . | |
| 2,613,932 | 10/1952 | Manners . | |
| 2,625,202 | 1/1953 | Richardson et al. . | |
| 2,855,202 | 10/1958 | Kinne . | |
| 3,336,922 | 8/1967 | Taylor . | |
| 3,957,040 | 5/1976 | Calabrese . | |
| 4,065,814 | 1/1978 | Fox . | |
| 4,188,966 | 2/1980 | Palmer et al. . | |
| 4,352,352 | 10/1982 | Janovsky et al. . | |
| 4,541,421 | 9/1985 | Iversen et al. | 602/18 |
| 4,606,542 | 8/1986 | Segal . | |
| 4,645,198 | 2/1987 | Levenston . | |
| 4,650,182 | 3/1987 | Ross | 482/10 |
| 4,698,847 | 10/1987 | Yoshihara . | |
| 4,832,333 | 5/1989 | Lockett | 482/124 |
| 4,955,608 | 9/1990 | Dougherty et al. . | |
| 5,046,194 | 9/1991 | Alaniz et al. . | |
| 5,062,642 | 11/1991 | Berry et al. . | |
| 5,109,546 | 5/1992 | Dicker . | |
| 5,186,701 | 2/1993 | Wilkinson . | |
| 5,201,074 | 4/1993 | Dicker . | |
| 5,242,377 | 9/1993 | Boughner et al. | 602/17 |

FOREIGN PATENT DOCUMENTS

| | | |
|---|---|---|
| 480383 | 5/1916 | France . |
| 2269977 | 5/1975 | France . |
| 564863 | 8/1977 | U.S.S.R. . |
| 1639674 | 7/1991 | U.S.S.R. . |
| 1048148 | 11/1966 | United Kingdom . |

*Primary Examiner*—Lynne A. Reichard
*Attorney, Agent, or Firm*—Arnold, White & Durkee

[57] ABSTRACT

An apparatus for exercising the muscles surrounding the cervical spine of a person in an isokinetic manner, comprising: a headband adapted to fit around the person's head; a breast plate; a back plate; at least one strap adapted to hold the breast plate and back plate in position on the person's body; a belt adapted to fit around the person's lower torso and lower back, wherein the belt is coupled to the breast plate or back plate; a lumbar belt adapted to fit around the person's waist; a plurality of adjustable non-elastic straps with isokinetic tensioners adapted to provide tensile loads between the headband and the breast and back plates; a plurality of adjustable elastic straps adapted to provide tensile loads between the headband and the breast and back plates; and a plurality of adjustable elastic straps adapted to provide tensile loads between the breast and back plates and the lumbar belt.

7 Claims, 3 Drawing Sheets

ISOKINETIC CERVICAL EXERCISE DEVICE

BACKGROUND OF THE INVENTION

This application is a continuation-in-part of patent application Ser. No. 08/208,991 filed Mar. 10, 1994 now abandoned which is a continuation-in-part of Ser. No. 08/134,800 filed Oct. 12, 1993 now U.S. Pat. No. 5,336,139 which is a C-I-P of U.S. Ser. No. 029,874, filed Mar. 11, 1993 now abandoned.

1. Field of the Invention

The subject invention relates generally to exercise devices and, more particularly, to medical implements designed to strengthen, support, and rehabilitate neck muscles surrounding the cervical spine and provide support for the back. The device of this invention is a functional assemblage of components arranged to universally fit patients or other users. The individual components can be assembled into multiple embodiments.

2. Description of the Prior Art

A variety of exercise and medical devices have been used in the past to exercise or rehabilitate the neck or spine of individuals. Typically, such devices are used by individuals recuperating from accidents, e.g., automobile or athletic. The prior art devices can generally be characterized as cumbersome, unattractive, and ineffective. The use of such devices has been hampered by the requirement that movement and activity while such devices are worn is extremely limited.

The isokinetic device of this invention solves these prior art problems by providing a device that is worn during normal activity and that achieves its therapeutic benefits during such routine use. The device of this invention has utility both as an exercise device and as a medical device for isokinetic treatment of the neck and cervical spine area. The device of this invention simultaneously provides exercise, support and recuperative ability.

One of the known devices used in the prior art for exercising the human neck, involves the use of a series of straps of cloth material which are sewn or otherwise secured together to form a hat-like pocket for cradling the head of the person whose neck is to be exercised. Portions of the straps are arranged to depend from the hat portion of this prior art device so as to extend substantially below the neck and shoulders of the person performing a neck exercise routine but not, typically, below the waist of such user. The ends of such straps terminate in loops for anchoring suitable weighted objects thereto.

The use of this prior art neck exercising device involves placing the hat portion over the head of the person whose neck is to be exercised, affixing one or more weighted objects to the looped portions of the depending straps and thereafter moving the neck up and down and side to side. The weighted objects provide a constant pull or "force" which is transmitted to the user's neck via the depending straps and the hat structure formed by the sewn straps. The neck is thereby exercised along with the muscles of the human body which are associated with the movement of the human neck. At least one deficiency with this prior art device lies in the inability of the user to comfortably stand up and exercise his neck; the contact of the weighted objects with his body is in some cases intolerable and in other cases, simply a nuisance and a source of irritation.

Another prior art neck exercising device includes an upright frame capable of surrounding the upper torso of a person. This device includes: a pair of handles manual gripping of the frame, a plurality of weighted objects, and some flexible ropes. One end of each rope is secured to one of the weighted objects. The device further includes guide means secured to a frame for guiding each of the plurality of ropes; means for securing the ropes to the weighted objects; and means for securing the unattached ends of the ropes to the head of the person using the device. The use of this prior art device relies on movements of the weights which are intended to strengthen the neck. This device, however, can present problems when used by patients with a herniated disc. The weights can cause additional compression of the cervical spine and therefore, possibly exacerbate the injuries of the cervical spine. In addition, the use of the frame is cumbersome and a nuisance.

At this time, there is a continuing need for a device for exercising the cervical spine as it relates to rehabilitation of injuries to the cervical spine, deformities of the cervical spine and disease of the spine affecting the neck area. There is also a need for strengthening soft tissues and ligamentous tissues, such as the anterior, posterior and left and right lateral longitudinal ligaments of the cervical spine. A device is especially needed when these areas have been exposed to trauma and injury has resulted. A device is also needed for those people suffering from a weakness in the cervical spine from other causes other than trauma. Especially needed is a device which can address the above needs while depending solely on isokinetic responses (without weights) to natural movements, and allows the person to use the device while engaging in almost any type of activity. Such a device would an improvement over the prior art and is described herein.

SUMMARY OF THE INVENTION

The present invention generally concerns a medical device for exercising the muscles surrounding the cervical spine of a person. In the broadest embodiment of the medical device of this invention, an assemblage of elements including a cranial support means, a breast plate, a back plate, a lumbar belt, a plurality of positioning straps, a plurality of elastic straps, and a plurality of non-elastic straps are functionally interconnected to form the medical device of this invention. Tension means are attached to the non-elastic straps. In turn, the tension means are attached to the cranial support means. Optionally, a chin cup is interconnected to the breast plate. The individual tension means provide resistance in all directions to the nonelastic straps. Thus, isokinetic tension is supplied to the cervical muscles at all times during movement.

One embodiment of the invention comprises a breast plate; a back plate; a headband adapted to fit around a person's head; a belt adapted to fit around a person's lower torso lower back; a lumbar belt adapted to fit around a person's waist; a pair of straps wherein one strap extends over a person's left shoulder and connects the respective left upper portions of the breast and back plate, and one strap extends over a person's right shoulder and connects the respective right portions of the breast plate and back plate; and a plurality of non-elastic straps are connected to the headband by isokinetic tension devices adapted to provide resistance between either or both the headband and the breast plate and the headband and back plate in all directions of movement. Alternatively, the isokinetic tension devices could be located between the non-elastic strap and either or both the breast and back plates. Additionally, a plurality of non-elastic straps are connected by tension means at one end to provide resistance between the breast plate and lumbar belt and between the back plate and lumbar belt. Also in this embodiment, the lumbar belt is connected to the breast plate by a loop fastener means and a chin cup is optional.

In the most preferred embodiment, a combination of elastic and non-elastic straps are used. In this embodiment, a plurality of non-elastic straps with tension control means and elastic straps are functionally interconnected to provide resistance to the various parts of the device of this invention. More particularly, one or more non-elastic straps with tension control means are placed in various areas of the device to provide isokinetic resistance between such areas such as the headband and breast or back plate and the breast or back plate and the lumbar belt. Likewise, one or more elastic straps are placed in various areas on the device to provide tensile loads between areas such as the headband and breast or back plate and the lumbar belt and the breast or back plate. An optional chin cup may be connected to breast plate by either an elastic strap by itself or a non-elastic strap with a tension control means.

Figure 2:
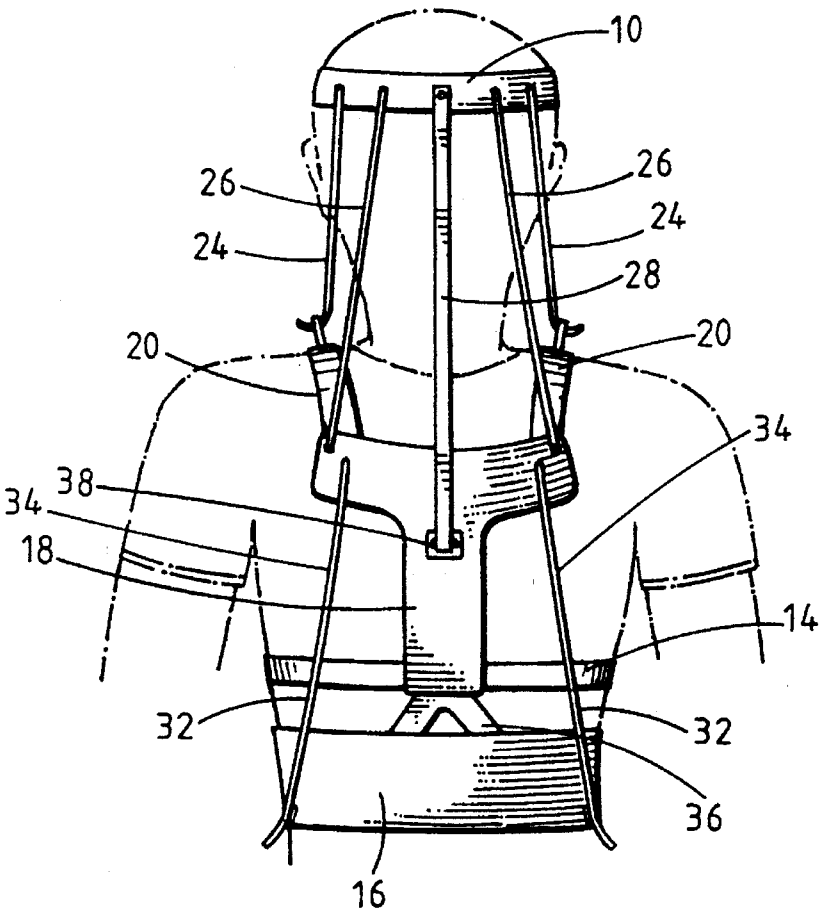
FIG. 2 is a posterior view of a person wearing the embodiment of the device of FIG. 1 in a neutral position.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives following within the spirit and scope of the invention as defined by the appended claims.

DETAILED DESCRIPTION OF THE PREFERRED EMBODIMENTS

The present invention is an isokinetic cervical exercise device designed to create an isotonic movement of the cervical spine to strengthen the soft tissues, including ligamentous, muscle and other soft tissue connections affecting the cervical spine.

In its broadest application, the medical device of this invention includes a cranial support means, a breast plate, a back plate, non-elastic straps with isokinetic tension control means connecting the cranial support means to the front and back body support means, elastic straps connecting the cranial support means to the front and back body support means, a lumbar belt, positioning straps connecting the lumbar belt to the front and back body support means and elastic straps connecting the lumbar belt to the front and back body support means. The cranial support means is generally designated by the numeral 10 and in its most preferred embodiment takes the form of a headband. Other more rigid structures are likewise useable. The purpose of the cranial support means 10 is to provide the cranial attachment for non-elastic straps with isokinetic tension control means and elastic straps. Therefore, the cranial support means may take the form of any convenient headband or similar such structure. It is necessary that cranial support device 10 have a plurality of connecting means for receiving one end of either non-elastic straps with isokinetic tension control means or elastic straps.

In its most preferred embodiment, the medical device of this invention also includes front and back body support means. The purpose of the body support means is to provide an anchoring area on the user's body for the various elastic and inelastic straps that are used to interconnect the components of the assembly of this invention. In one form, the front and back body support means are hard plates with attachment sites for the non-elastic straps with isokinetic tension control means, elastic straps and inelastic position straps of the invention. Front body support means are generally designated by the number 12 and back body support means are generally designated by the number 18. Both the front and back body support means include receptive sites for non-elastic straps with isokinetic tension control means, elastic straps and inelastic positioning straps interconnecting with the cranial support means and the lumbar belt. In its preferred embodiment, both the front and back body support means are made from a hard plastic in a functionally effective shape to maintain the position of the portion of the apparatus strapped to the upper torso in comparison to the movement of the cranial support means engaged by the head of the user. Other forms and other materials are equally applicable to the front and back body support means. In a most preferred embodiment, the front body support means takes the form of a breast plate made of a hard plastic material with a cushioning material on the inside. Likewise, in a most preferred embodiment, the back body support means is made of a hard plastic material with a cushioning material likewise included.

A third component of the assemblage of this invention is the lumbar belt 16. Lumbar belt 16 takes the form of what are generally referred to as back support belts typically worn by workers whose duties include lifting of materials. The lumbar belts are typically four to ten inches in width and are made of leather or a synthetic material. The lumbar belts are structurally rigid to provide a firm anchor for the front and back body support means and the cranial support means. In many instances, the lumbar belt has a buckle engagement means or a velcro engagement means. The size and shape of the belt can be custom designed to fit the particular user.

In connecting the cranial support means 10, front body support means 12, back body support means 18 and lumbar belt 16 are a series of non-elastic straps with isokinetic tension control means, elastic straps and inelastic positioning straps.

The non-elastic strap with isokinetic tension control means may take the form of twine, rope, wire, plastic coated wire, flat cloth material, or any other convenient form that permits isokinetic tension control. Isokinetic tension control means are old in the art. Common examples of isokinetic tension control means include automobile seat-belt tension mechanisms and starting rope recoil mechanisms for gasoline powered lawn care products. A simple isokinetic tension control device may be created by rapping a non-elastic strap over a spool which is connected to a support frame by a torsion spring. When the non-elastic strap is pulled, it causes the spool to rotate with respect to the support frame. This rotation is resisted by the spring. This resistance results in a tension on the non-elastic strap. The forward isokinetic tension control means is numbered 37. The rearward isokinetic tension control means is numbered 38.

The elastic straps may take the form of elasticized tubing or flat elasticized cloth material or any other convenient material that causes tension.

A first set of non-elastic straps with isokinetic tension control means and elastic straps connect the cranial support means 10 to the front and back body support means 12 and 18. These straps are generally identified by the numerals 22, 26, and 28. Although the drawings show specific locations for both the non-elastic straps with isokinetic tension control means and the elastic straps, the location and number of the non-elastic straps with isokinetic tension control means and the location and number of the elastic straps can be modified to meet the specific needs of the user. It should be understood that the invention is not intended to be limited to the particular arrangement of straps shown.

A plurality of non-elastic straps with isokinetic tension control means and a plurality of elastic straps are necessary to connect the cranial support means to the front and back body support means in order to provide both isokinetic tension and isotonic tension for both front and back movement of the cranial area. Additional straps are likewise preferred to provide a combination of isokinetic and isotonic tension for whatever direction the cranial area is moved.

Similarly, elastic straps 32 are used to connect the lumbar belt to the front and back body support means. This interconnection provides additional tension and isotonic exercise to the cranial and cervical areas. The elastic straps are similar to those used to connect the front and back body support means to the cranial support means. In each instance, the elastic strap may be adjustable to accommodate different sizes of users and different desired tensions.

Positioning straps 36 are used to connect the front and back body support means to the lumbar belt. These straps are not intended to be elastic although in certain embodiments they may be slightly elastic. The purpose of positioning straps 36 is to firmly anchor the front and back body support means and to position said control means relatively firmly on the body of the user. In the most preferred embodiment of this invention, positioning straps 36 are inelastic velcro straps attachable to lumbar belt 16.

In its most preferred embodiment the device generally comprises: a breast plate; a back plate; a headband adapted to fit around a person's head; a belt adapted to fit around a person's lower torso and back; a lumbar belt adapted to fit around a person's waist; a pair of straps adapted to extend over a person's shoulders and connect the respective right and left sides of the upper portions of the breast plate and back plate; and a plurality of adjustable elastic straps adapted to provide tensile loads between the headband and the breast and back plates, and between the lumbar belt and the breast and back plates.

The device can operate in an isokinetic manner or in a combination isokinetic/isotonic manner depending on whether all of the straps which connect to the cranial support are non-elastic straps with isokinetic tension control means or whether some of the straps are elastic.

Each of the elastic straps are adjustable so that when the device is placed on a person, each strap is tightened to the point of resistance. The point of resistance is the amount of tension that occurs just prior to the point where a pulling effect occurs. Thus, when the device is in operation, any movement caused by the person, such as anterior flexion, posterior extension, left and right lateral flexion or left and right rotation is affected by the restraint effect of the elastic straps, thereby accomplishing an isotonic type of resistance for building of the soft tissue surrounding the spine.

The tension of the non-elastic straps with isokinetic tension control means are also adjustable. Adjustment is accomplished by shortening or lengthening the nonelastic straps. If a non-elastic strap is shortened, the tension on the non-elastic strap will increase because the isokinetic tension means will uncoil and exert a greater force. Likewise, if a non-elastic strap is lengthened, the tension on the non-elastic strap will decrease.

The device is unique because it requires only the movement of the cervical spine in a natural motion in order to achieve either an isokinetic or a combination isokinetic and isotonic response. Such responses strengthen the tissue surrounding the cervical spine. The device achieves the foregoing result without the need of cumbersome weights. In addition, it does not depend on an isometric response, which is a force against an unmovable source. Therefore, the device allows a person to engage in almost any type of activity while wearing (operating) the device, including, but not limited to, household activities and work activities, whether sitting, lying, standing or walking.

Figure 1:
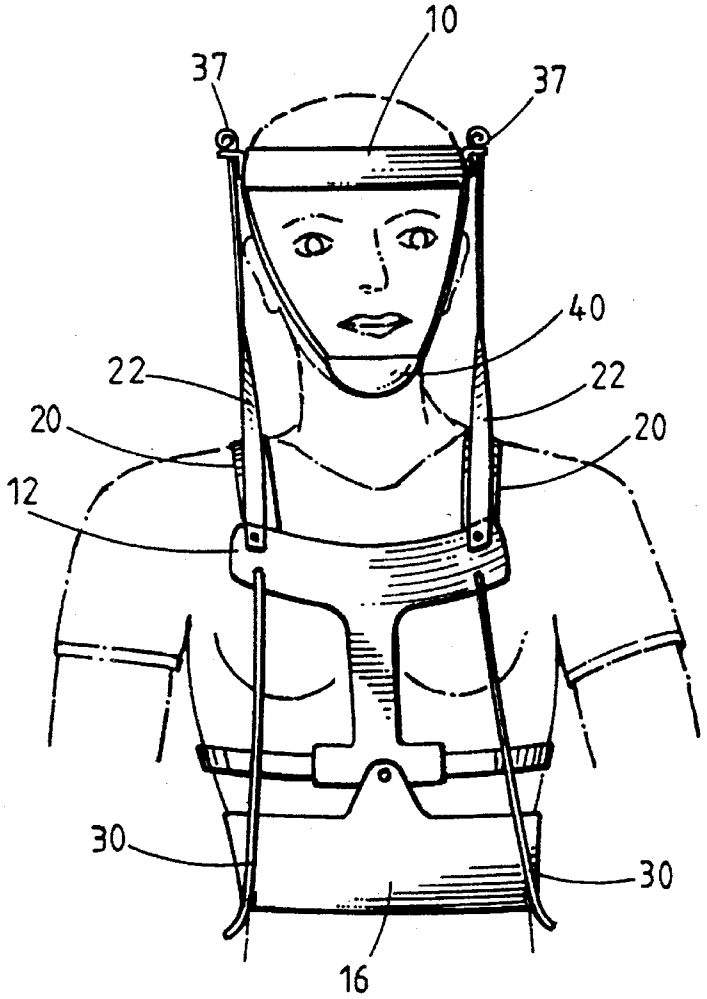
FIG. 1 is a front view of a person wearing an embodiment of the invention in a neutral position.
Figure 3:
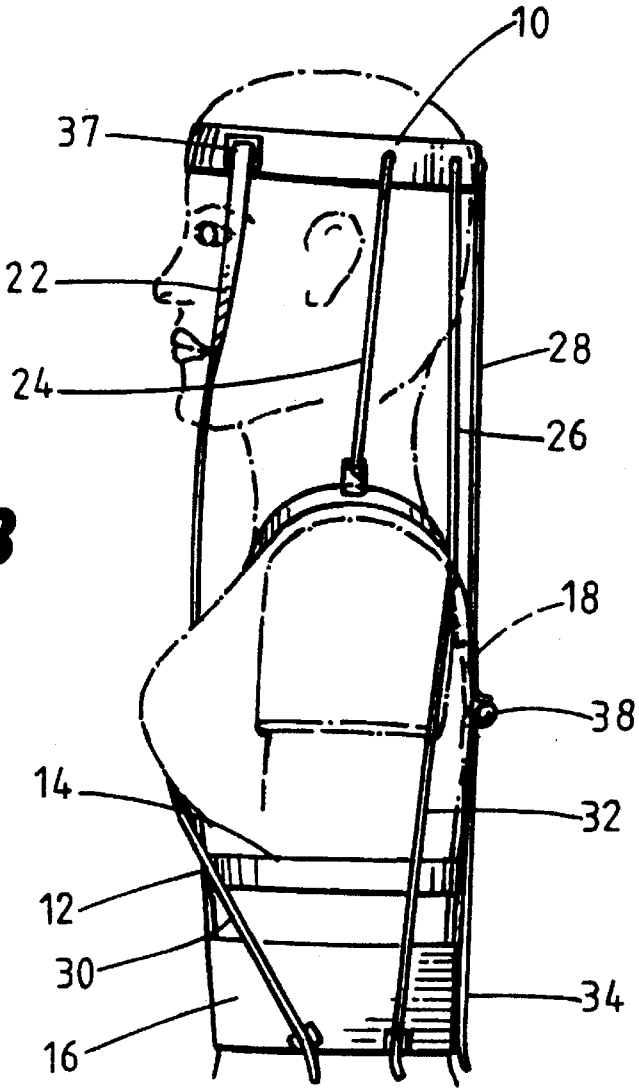
FIG. 3 is the corresponding side view of a person wearing the embodiment of the device of FIG. 1 in a neutral position.
Figure 5:
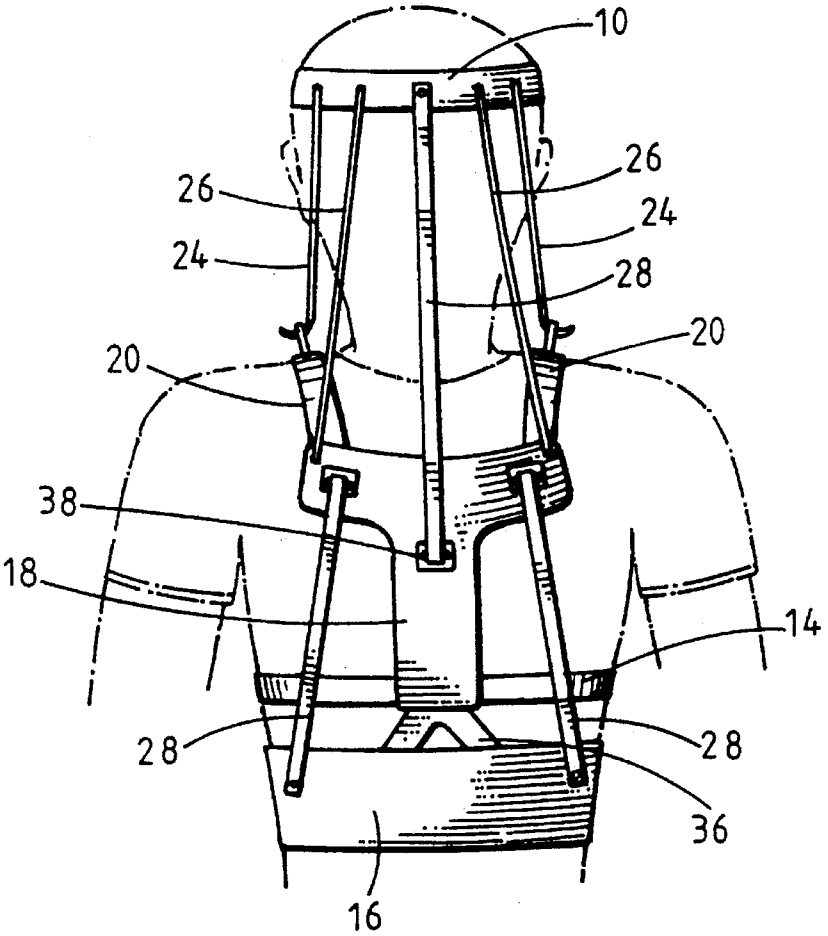
FIG. 5 is a posterior view of a person wearing an embodiment of the invention wherein the breast plate and back plates are connected to the lumbar belt by non-elastic straps with tension control means.
Figure 4:
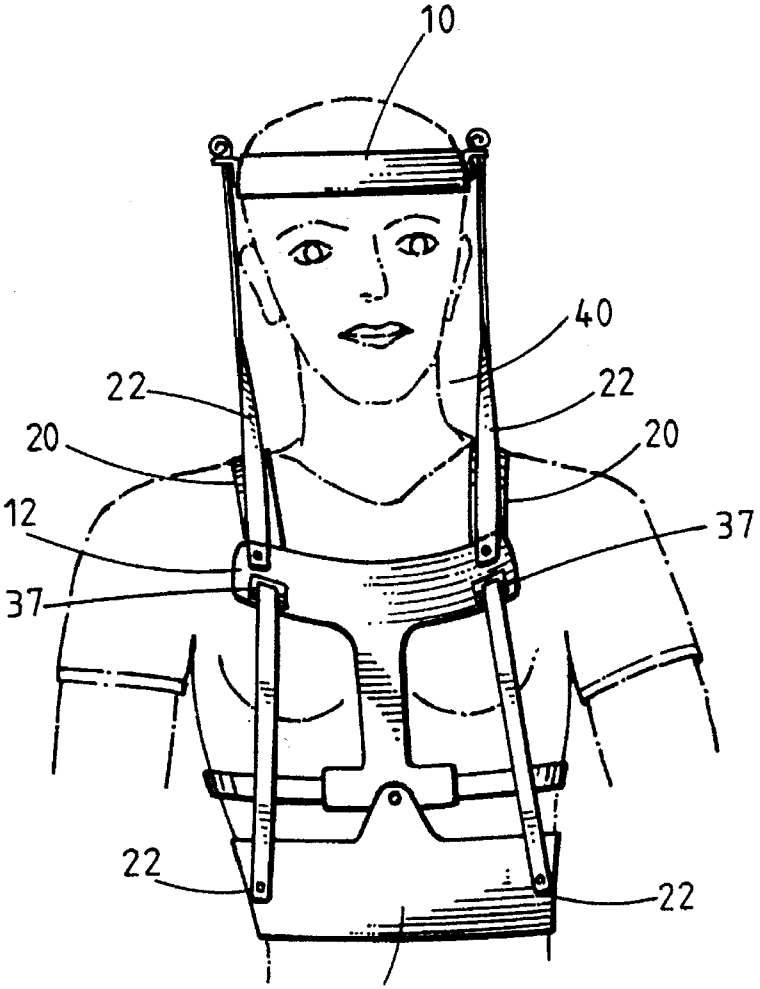
FIG. 4 is a front view of a person wearing an embodiment of the invention wherein the breast plate and back plate are connected to the lumbar belt by non-elastic straps with tension control means.

Turning now to the drawings, FIG. 1 is a front view of a person wearing an embodiment of the isotonic cervical exercise device in a neutral position. FIG. 2 is a posterior view of a person wearing the embodiment of the isotonic cervical exercise device of FIG. 1 in a neutral position. FIG. 3 is a side view of a person wearing the embodiment of FIGS. 1 and 2 in a neutral position.

Referring to FIGS. 1, 2 and 3, a headband 10 is adapted to be secured around a person's head, and includes frontal and posterior portions corresponding to the respective sides of the person's body. A breast plate 12 is adapted to fit against the frontal side of a person's body. The breast plate 12 may further include a padding on one side of the breast plate to act as a cushion between the breast plate 12 and the person's body. A belt 14 is adapted to fit around the person's lower torso and lower back. The belt 14 is coupled to the breast plate or back plate.

A lumbar belt 16 is adapted to fit around a person's waist or lower torso and is releasably coupled to the breast plate or back plate. The lumbar belt 16 may provide back support to the person. In addition, the lumbar belt 16 acts as an anchoring mechanism for elastic straps. A back plate 18 is adapted to fit against the posterior portion of the person's body. More particularly, the back plate 18 is adapted to fit against a person's back and may further include a padding on one side to act as a cushion between the back plate and the person's body.

A pair of straps 20 are adapted to hold the breast plate 12 and back plate 18 in position on the person's body. A first strap 20 is connected at one end to the upper left portion of the breast plate 12, extends over the person's left shoulder and is connected at the opposite end to the upper left portion of the back plate 18. A second strap 20 is connected at one end to the upper right portion of the breast plate 12, extends over the person's right shoulder, and is connected at the opposite end to the upper right portion of the back plate 12.

A plurality of adjustable non-elastic 22 and 28 and elastic straps 24 and 26 are adapted to provide tensile loads between the headband 10 and breast plate 12, back plate 18 and straps 20. In this embodiment, a pair of adjustable non-elastic straps 22 with isokinetic tension control means 37 provide tensile loads between the right and left frontal portions of the headband 10 and the right and left upper portions of the breast plate 12, respectively; a pair of adjustable elastic straps 24 are adapted to provide tensile loads between the right and left posterior portions of the headband 10 and the right and left straps 20, respectively; a pair of adjustable elastic straps 26 are adapted to provide tensile loads between the right and left posterior portions of headband 10 and the right and left upper portions of the back plate 18, respectively; and an adjustable non-elastic strap 28 with an isokinetic tension control means 38 is adapted to provide a tensile load between the middle posterior portion of the headband 10 and the middle portion of back plate 18.

Also in this embodiment, a plurality of adjustable elastic straps 30, 32 and 34 are adapted to provide tensile loads between the breast plate 12 and the lumbar belt 16, and between the back plate 18 and the lumbar belt 16. More particularly, a pair of adjustable elastic straps 30 are adapted to provide tensile loads between the fight and left upper portions of the breast plate 12 and a fight and left portion of the lumbar belt 16, respectively. Additionally, a pair of adjustable elastic straps 32 are adapted to provide tensile loads between the upper right and left portions of back plate 18 and the right and left portions of the lumbar belt 16, respectively. Also in this embodiment, a pair of adjustable elastic straps 34 are adapted to provide tensile loads between fight and left portions of back plate 18 and the fight and left portions of lumbar belt 16, respectively.

An embodiment of this invention may include an optional chin cup adapted to fit around a person's chin. The chin cup 40 may be held in place on the person's chin by one or more adjustable elastic straps adapted to provide tensile loads between the fight and left sides of the chin cup and the headband. In addition, one or more adjustable non-elastic straps with isokinetic tension control means or adjustable elastic straps may be adapted to provide tensile loads between the chin cup and the straps 20, breast plate 12, belt 14 or lumbar belt 16.

What is claimed is:

1. A medical device for treatment of the musculature of the cervical spine comprising:

(a) a cranial support means adapted to engage the cranial area of a user, said cranial support means having at least one tension control means for providing resistance to non-elastic straps, said cranial support means having at least one attachment means for securing elastic straps;

(b) body support means for providing an anchoring area for one or more said non-elastic straps with said tension control means and one or more said elastic straps;

(c) a belt adapted to be adjustable around users waist or lower torso, said belt including a plurality of attachments for non-elastic and elastic straps;

(d) at least one positioning strap adjustably connecting said belt to said body support means, and at least one positioning strap also maintaining said body support means in a relatively fixed position; and (e) a plurality of non-elastic straps with tension control means or elastic straps without tension control means connecting said belt to said body support means.

2. The device of claim 1 wherein said body support means comprises a breast plate and a back plate.

3. The device of claim 1 wherein said tension control means further comprises a tensioner roller device.

4. A device for treatment of the musculature of the cervical spine comprising:

(a) cranial support means adapted to removably engage the cranial area of a user containing at least one tensioner roller device for providing resistance to at least one non-elastic strap;

(b) a plurality of non-elastic straps with tensioner roller devices;

(c) body support means for providing an anchoring area for said plurality of non-elastic straps and tensioner roller devices, said body support means functionally connected to said cranial support means by at least one said non-elastic strap;

(d) a belt adapted to fit around user's waist or lower torso;

(e) a plurality of positioning straps adjustably connecting said belt to said body support means, said positioning straps also maintaining said body support means in a relatively fixed position; and (f) a plurality of said non-elastic straps with tensioner roller devices or elastic straps without tensioner roller devices connecting said belt to said body support means.

5. A device for treatment of the musculature of the cervical spine comprising:

(a) cranial support means adapted to removably engage the cranial area of a user containing at least one tensioner roller for providing resistance to at least one non-elastic strap;

(b) a plurality of non-elastic straps with tensioner rollers;

(c) body support means for providing an anchoring area for a said plurality of said non-elastic straps with tensioner rollers, said body support means functionally connected to said cranial support means by at least one said non-elastic strap;

(d) a belt adapted to fit around said user's waist or lower torso;

(e) a plurality of positioning straps adjustably connecting said belt to said body support means, said positioning straps also maintaining said body support means in a relatively fixed position; and (f) a plurality of said non-elastic straps with said tensioner rollers or elastic straps without tensioner rollers connecting said belt to said body support means.

6. The device of claim 5 wherein said device comprises a chin cup.

7. The device of claim 6 further comprising at least one non-elastic strap fixedly connected to said chin cup at one end and connected to said breast plate or belt at the other end by one of said tensioner roller.

* * * * *

UNITED STATES PATENT AND TRADEMARK OFFICE

CERTIFICATE OF CORRECTION

PATENT NO. : 5,507,707

DATED : April 16, 1996

INVENTOR(S) : Bruce W. Miller

It is certified that error appears in the above-indentified patent and that said Letters Patent is hereby corrected as shown below:

Column 7, line 16, please delete "fight" and insert --right--;

Column 7, line 17, please delete "fight" and insert --right--;

Column 7, line 24, [2 times], please delete "fight" and insert --right--;

Column 7, line 30, please delete "fight" and insert --right--.

Signed and Sealed this

Twenty-fifth Day of June, 1996

*Attest:*

*Attesting Officer*

BRUCE LEHMAN

*Commissioner of Patents and Trademarks*